United States Patent [19]

Cook et al.

[11] 3,945,081

[45] Mar. 23, 1976

[54] LOOM CLEANER

[75] Inventors: Virgil W. Cook, Charlotte, N.C.; Charles D. Spates, Fairfield, Iowa; Charles Wayne Heil, deceased, late of Fairfield, Iowa; by Terry W. Heil, executor; by Kay A. Diers, executrix, both of Fairfield, Iowa

[73] Assignee: American Chain & Cable Company, Inc., Bridgeport, Conn.

[22] Filed: Mar. 27, 1974

[21] Appl. No.: 455,199

[52] U.S. Cl. ..... 15/312 R

[51] Int. Cl.[2] ..... A47L 5/38; B08B 5/04

[58] Field of Search ..... 15/312 A, 312 R

[56] References Cited

UNITED STATES PATENTS

| | | | |
|---|---|---|---|
| 3,153,803 | 10/1964 | Bahnson, Jr. | 15/312 R |
| 3,276,065 | 10/1966 | King, Jr., et al. | 15/312 A |
| 3,299,463 | 1/1967 | McEachern | 15/312 A |
| 3,304,570 | 2/1967 | Seress et al. | 15/312 R |
| 3,422,481 | 1/1969 | Black, Jr. | 15/312 R |

*Primary Examiner*—Harvey Hornsby
*Assistant Examiner*—C. K. Moore
*Attorney, Agent, or Firm*—Barnes, Kisselle, Raisch & Choate

[57] ABSTRACT

A loom cleaner for cleaning a plurality of looms in a row comprising a carriage adapted to be moved along an overhead track above the row of looms. A pair of spaced blowers are provided on the carriage. Each blower includes a scroll and a fan. A motor on the carriage drives a horizontal shaft connected to the fans of the blowers. A plenum is associated with the outlet of each blower scroll and is mounted for swinging movement about a horizontal axis intersecting said outlet. Means are provided for oscillating the plenums about their respective axes. A plurality of blower tubes extend downwardly from each said plenum and are oscillated as each plenum is oscillated.

14 Claims, 11 Drawing Figures

LOOM CLEANER

This invention relates to loom cleaners.

BACKGROUND OF THE INVENTION

In the operation of looms in textile mills and particularly looms for weaving fancy fabrics, it is common to use a dobby to control the loom harness. The dobby includes jacks which are actuated by a pattern chain and the more complicated the fabric, the longer the chain. The chain is often supported by a chain guide or rack above the arch of the loom. Heretofore in weave rooms with this type of loom arrangement, there was seldom sufficient room for loom cleaning.

Among the objects of the invention are to provide a loom cleaner which can be used with looms of this type wherein there is low headroom, which loom cleaner can be rapidly changed to accommodate different and new types of looms without expensive alterations and which loom cleaner will efficiently clean the various areas of the loom.

Another problem with loom cleaners that have been heretofore used is that with new shuttle-less looms and weaving machines having cones of yarn mounted on the side of the loom to supply the filling to the fabric in place of a filling bobbin in a shuttle, the nature of the operations precludes air from being blown at high velocities on the filling supply area. Accordingly, it has become common to reduce the amount of air used by the cleaner and, as a result, incomplete cleaning has been achieved.

Accordingly, among the objects of the invention is to provide a loom cleaner which will automatically regulate the volume and velocity of air as the cleaner moves across the critical filling supply area and, at the same time, will provide maximum volume and velocity of air to clean the body of the loom between the loom sides.

SUMMARY OF THE INVENTION

The loom cleaner for cleaning a plurality of looms in a row comprises a carriage adapted to be moved along a track above the row of looms, a motor on said carriage and a pair of spaced blowers on said carriage. Each blower includes a scroll and a fan. The motor drives a horizontal shaft connected to the fans of said blowers. A plenum is associated with the outlet of each blower and is mounted for swinging movement about a horizontal axis intersecting the outlet. Means are provided for oscillating the plenums about their respective axes, and a plurality of blower tubes extend downwardly from each said plenum and are oscillated as each plenum is oscillated. Damper means are associated with each scroll and are operated as the cleaner passes over the sides of the loom to reduce the volume and velocity of air passing to the filling supply area of the loom.

DESCRIPTION

Figure 1:
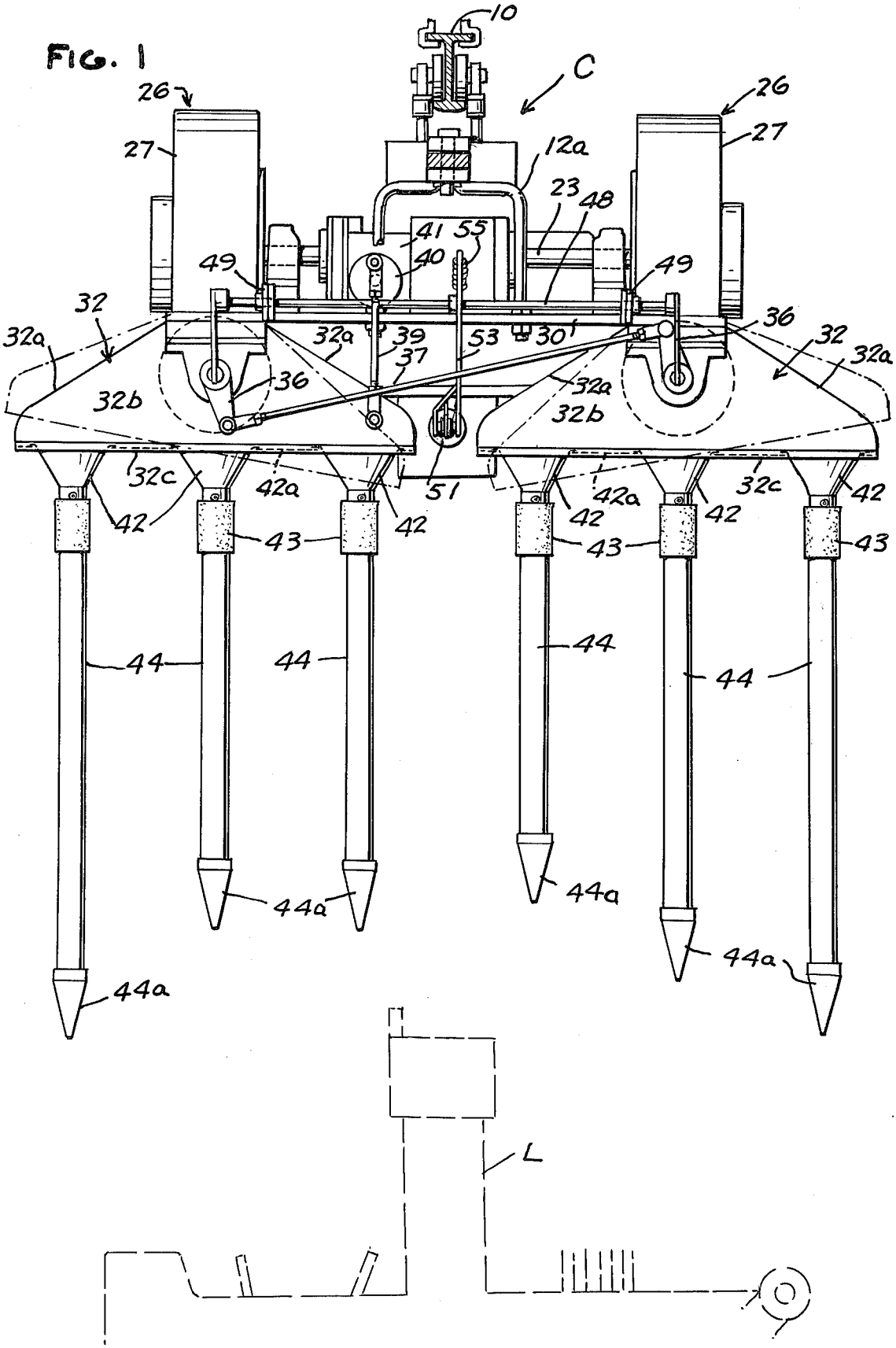
FIG. 1 is an elevational view of a loom cleaner, embodying the invention, suspended from a monorail.
Figure 2:
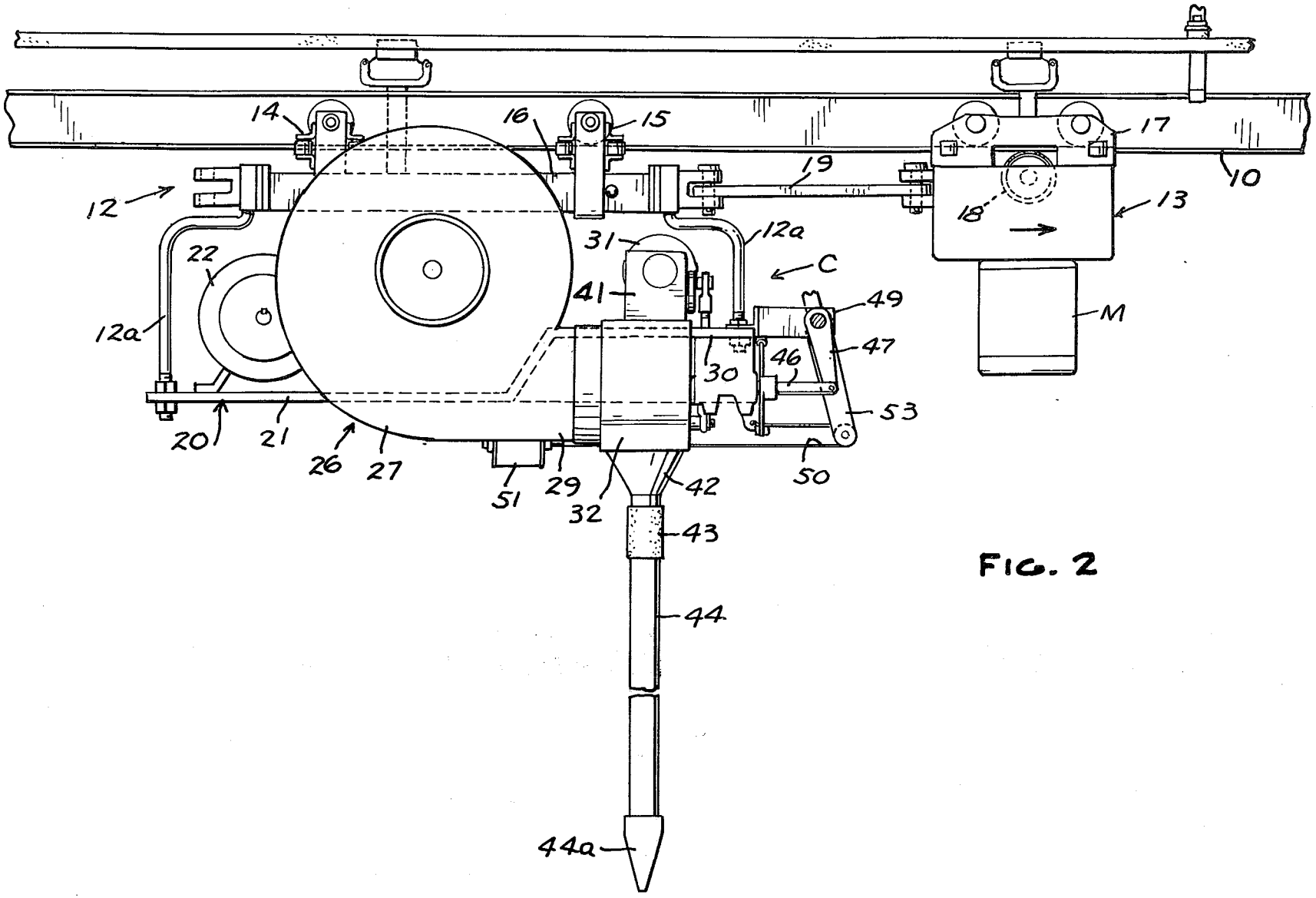
FIG. 2 is a side elevational view of the same.
Figure 3:
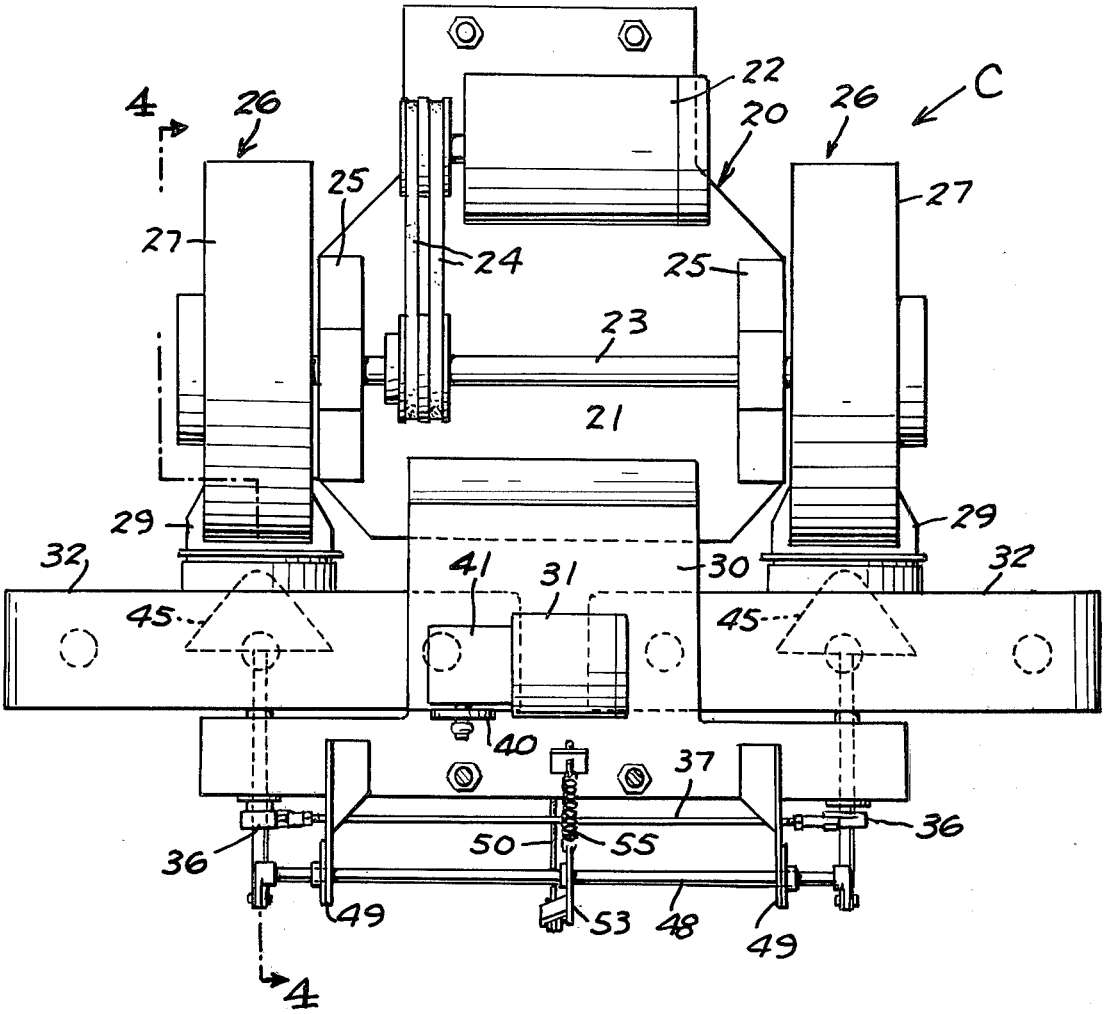
FIG. 3 is a plan view of the same.
Figure 4:
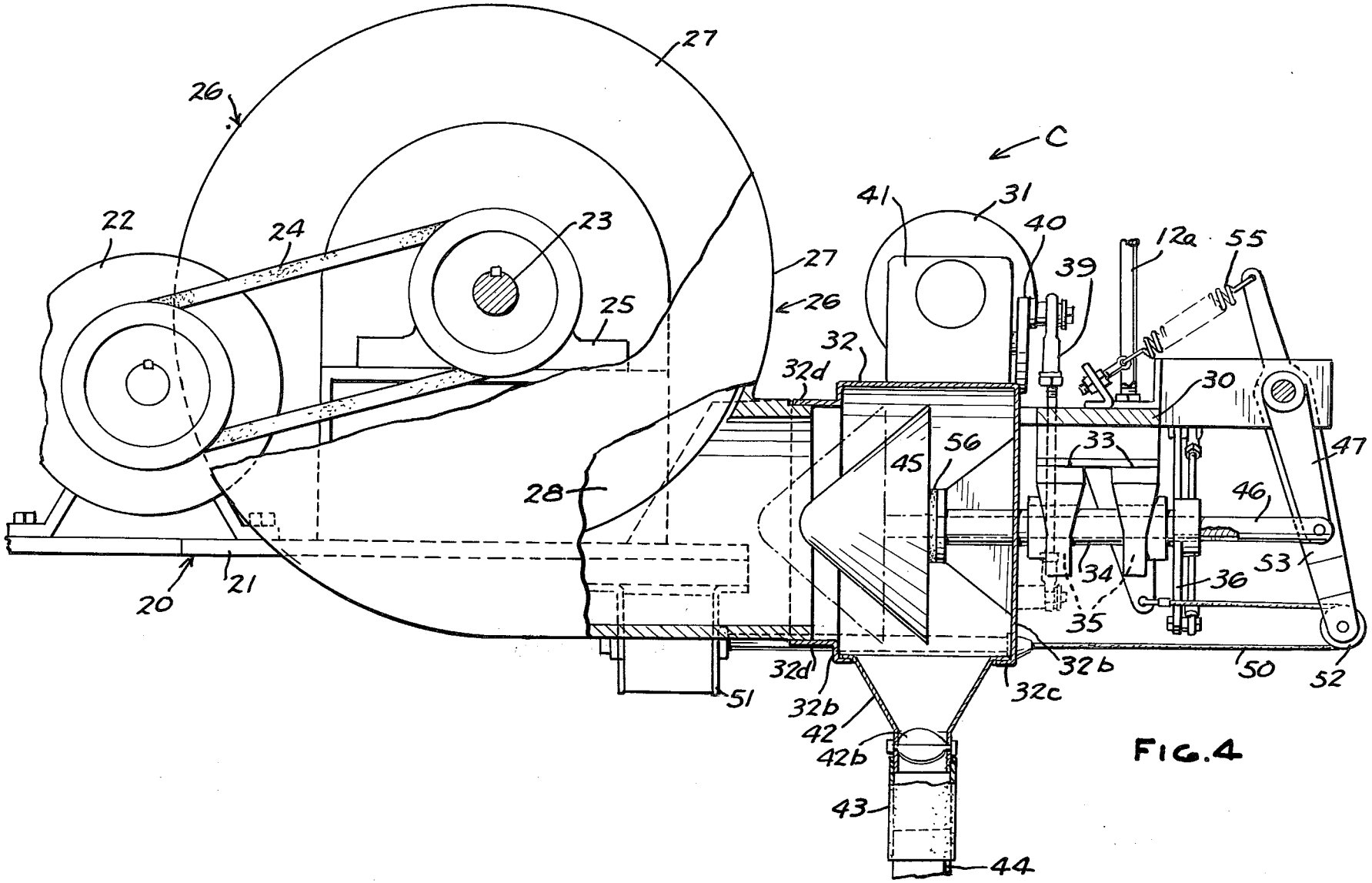
FIG. 4 is a part sectional view taken along the line 4—4 in FIG. 3.
Figure 5:
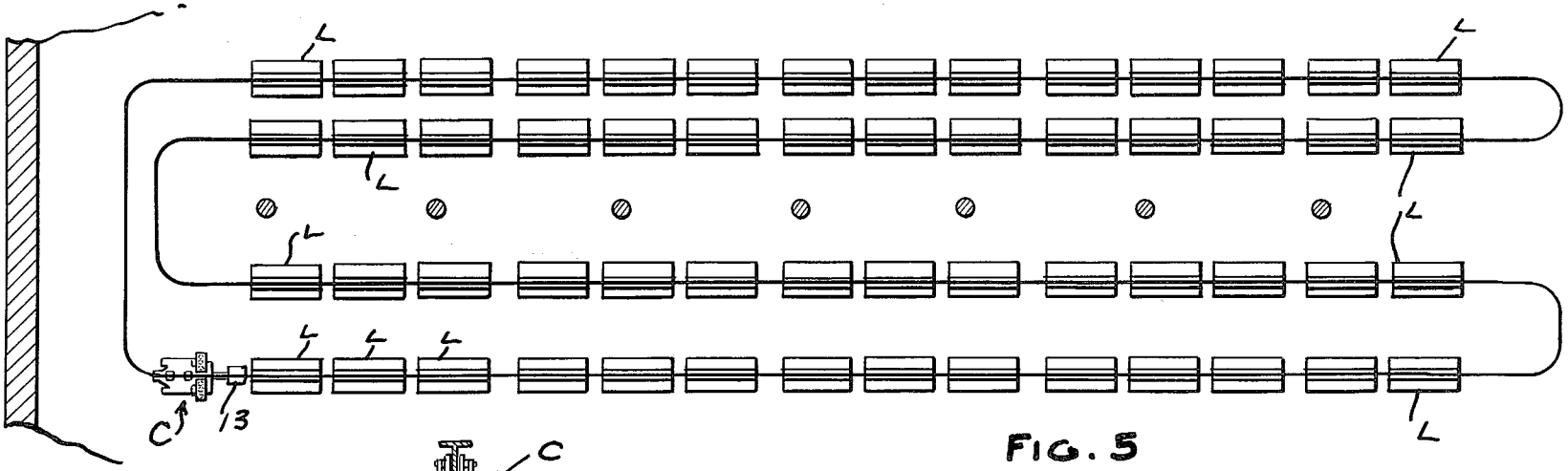
FIG. 5 is a diagrammatic plan view showing one manner in which the loom cleaner can be used on a monorail track.

Referring to FIG. 1, in one embodiment, the loom cleaner C embodying the invention is adapted to be mounted for movement on a monorail track 10 supported above a row of looms L (FIG. 5). Each loom cleaner includes a carriage 12 engaging the track and power means 13 for moving the carriage along the track. As shown in FIG. 2, carriage 12 comprises spaced wheeled trolleys 14, 15 engaging the track 10 and interconnected by a tie bar 16. Power means 13 comprises a wheeled support 17 on the track 10 supporting a motor M and gearing for driving a wheel 18 that engages the underside of the track 10. A tie bar 19 interconnects power means 13 with the carriage 12. The loom cleaner is supported on the carriage 12 as presently described.

Referring to FIGS. 1–4, the loom cleaner comprises a frame 20 including a flat horizontal plate portion 21 on which a motor 22 is supported and drives a jack shaft 23 through belts 24, the shaft 23 being journalled on pillow blocks 25. A blower 26 is mounted on each end of the plate 21 and includes a scroll 27 and a fan 28 driven by jack shaft 23. Each scroll 27 includes a horizontal tubular outlet 29. The frame 20 further includes a second vertically spaced horizontal plate portion 30 that supports a second motor 31 for a secondary drive as presently described. The frame 20 is suspended from carriage 12 by hangers 12*a*.

Chambers or plenums 32 are rotatably mounted by brackets 33 for rotation about the axes of the outlets 29. In vertical elevation, plenums 32 are generally triangular. More specifically, each plenum 32 comprises top walls 32*a*, vertical side walls 32*b*, and a bottom wall 32*c*. The angle between the top walls 32*a* is preferably obtuse. Each plenum 32 has a tubular portion 34 extending horizontally from a side wall 32*b* and journalled by bearings 35 in the brackets 33. An oscillating arm 36 is fixed to the tubular portion 34. The arms 36 of the two plenums are interconnected by a link 37. A second link 39 extends from one plenum 32 to an eccentric 40 of a gear box 41 driven by the motor 31. A tube 32*d* extends from the other side wall 32*b* of each plenum and outlet 29 of the scroll 27 telescopes into tube 32*d*.

A plurality of outlets 42 are provided on the bottom wall 32*c* of each plenum. The outlets 42 are spaced at varying intervals on the bottom wall 32*c* of each plenum by varying the length of filler plates 42*a*. This arrangement allows pin point location of outlets 42 over critical areas of the loom, and also provides means of easily relocating the outlets if looms over which the loom cleaner is operating are changed. The outlets 42 incorporate a damper plate 42*b* which is set to regulate the flow of air through the outlet. Flexible connectors 43 connect blower tubes 44 to outlets 42. Optional nozzles 44*a* may be attached to bottom of blower tubes 44.

Provision is made for varying the outlet of each scroll by a conical damper or baffle 45 mounted for sliding movement on a shaft 46 extending through each tube 34. Actuator arms 47 are pivoted to the ends of the shaft 46 and extend upwardly to a horizontal shaft 48 journalled in brackets 49 on the frame portion 30. A cable 50 is connected at one end to the plunger of an electrically operated power device such as a linear motor 51 and is trained over a pulley 52 on the end of lever 53 fixed on shaft 48. The other end of cable 50 is connected to a bracket 54 on the frame. A spring 55 connected between lever 53 and the frame yieldingly urges the baffles 45 in a direction away from the outlets and toward a stop 56 in each plenum. When linear motor 51 is energized, it moves the baffles 45 toward the outlets 29 reducing the passage of air out into the plenums 32 and, in turn, to the tubes 44.

Alternatively, a torque motor can be used instead of a linear motor 51 by connecting cable 50 to the rotor of the torque motor.

Figures 10, 11:
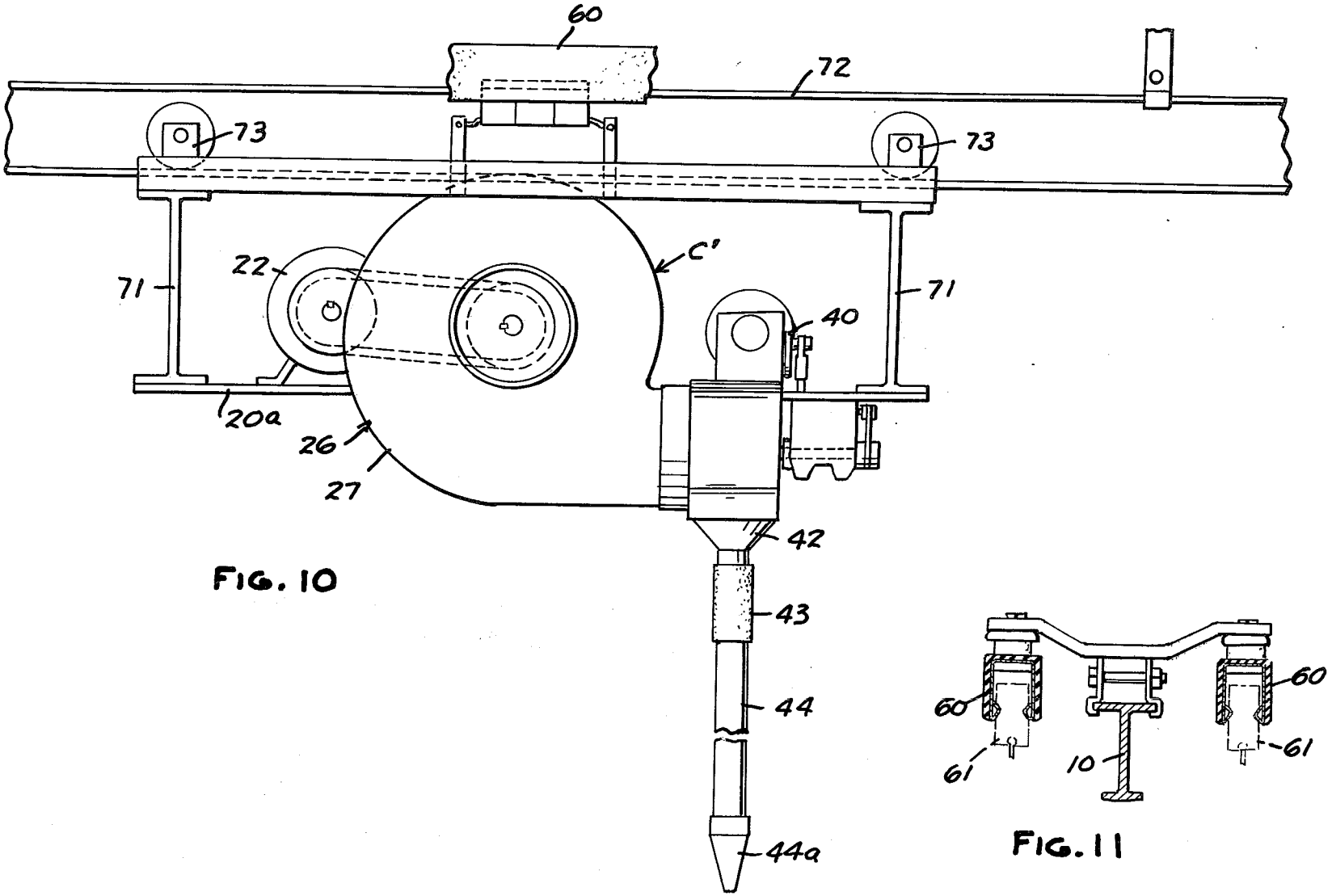
FIG. 10 is a fragmentary side elevational view taken along the line 10—10 in FIG. 8.
FIG. 11 is a typical vertical section showing the manner of making electrical connections along a track.

Provision for supplying current to the drive motor M, blower motor 22, oscillating motor 31 and torque motor 51 can be made by utilizing current supply tracks such as shown, for example, in U.S. Pat. No. 3,042,761. A typical section is shown in FIG. 11 and comprises conductor tracks 60 supported on track 10 in which a current collector 61 rides and is connected by wires 62 through fused main-line disconnect 63, 64 and 65 to the control panel (see FIG. 7). A signal is provided to the motor 51 as the carriage 12 moves along the track, the signal corresponding to the movement of the tubes 44 over the filling supply area of the loom.

Figure 6:
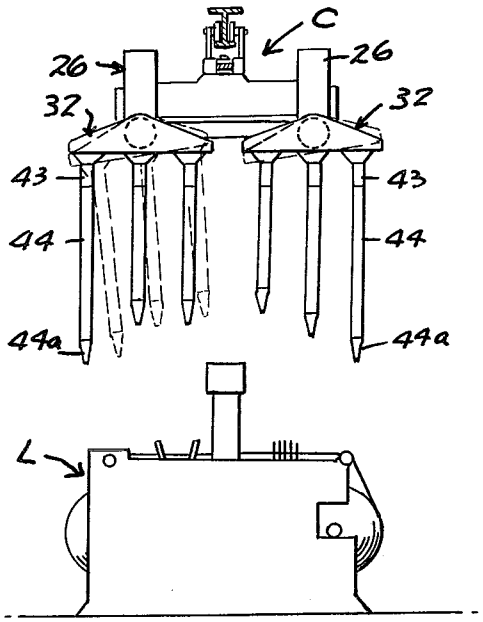
FIG. 6 is a partly diagrammatic elevational view showing the relationship of a loom cleaner to a typical loom.

Referring to FIGS. 5 and 6, in operation, as the carriage 12 is moved along the track, air at high velocity and high volume is supplied from the scrolls 27 to each plenum 32 and, in turn, from each plenum 32 downwardly through the tubes 44 to the loom. The oscillation of the plenums as the carriage is moved along insures the full distribution of air to various parts of the loom. As the tubes 44 pass over the filling supply area of each loom, the motor 51 is energized to move the dampers 45 inwardly to restrict the flow of air and thereby prevent large volumes of air at high velocities from passing to the critical filling supply areas. After the tubes 44 pass the supply area, the motor 51 is de-energized permitting the dampers to move to their full open positions.

The provision of two blowers driven by a common jack shaft 23 makes the cleaner readily adaptable to various size looms by merely replacing the jack shafts 23 and repositioning the blowers to accommodate looms of varying widths.

Figure 8:
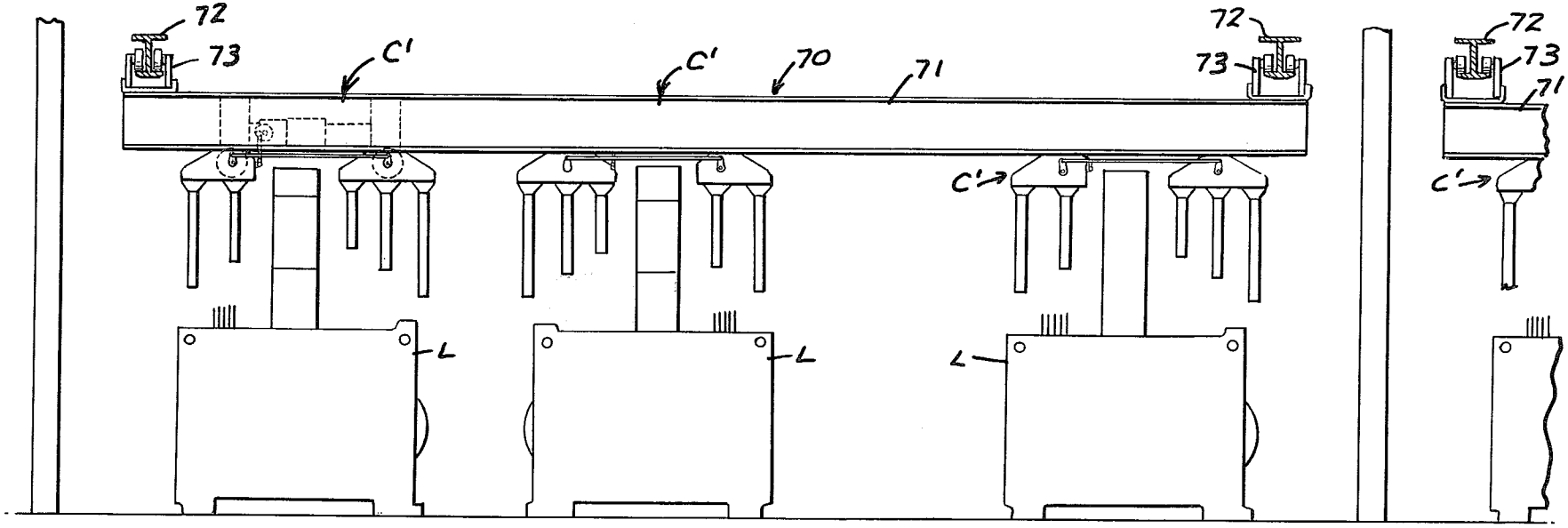
FIG. 8 is an elevational view of loom cleaners on a crane.
Figure 9:
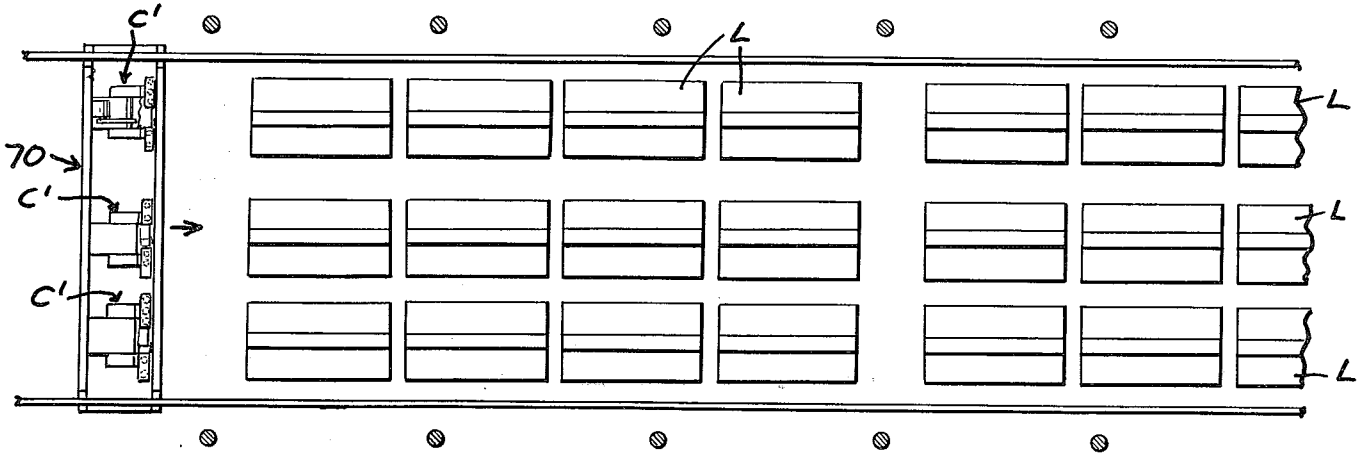
FIG. 9 is a diagrammatic plan view of the manner in which loom cleaners can be used on a crane.

The manner in which loom cleaners C′ embodying the invention can be used in connection with a crane moving over a plurality of rows of looms is shown in FIGS. 8–10. A plurality of loom cleaners, corresponding to the number of rows of looms spanned by the crane 70, are mounted on the crane. The crane 70 consists of two crane beams 71 supported from longitudinal rails 72 by conventional crane end trucks 73 and driven in a conventional manner. In this form, the frame 20*a* of the loom cleaner comprises a flat plate 21*a* supported between the bottom flanges of the beams 71 of the crane 70. The various components of the loom cleaner are supported on frame 20*a*. As shown, the center of the scrolls 27 is nearer the plate 21*a* than in the monoveyor form of the invention. As shown in FIG. 8, in this manner, it is possible to clean looms that have a high vertical height. As the crane is moved along its tracks, each loom cleaner cleans one row of looms. As in the previous form of the invention, the motors 51 are operated as the loom cleaners move over the filling supply areas to reduce the flow of air as the cleaners pass over these areas.

Figure 7:
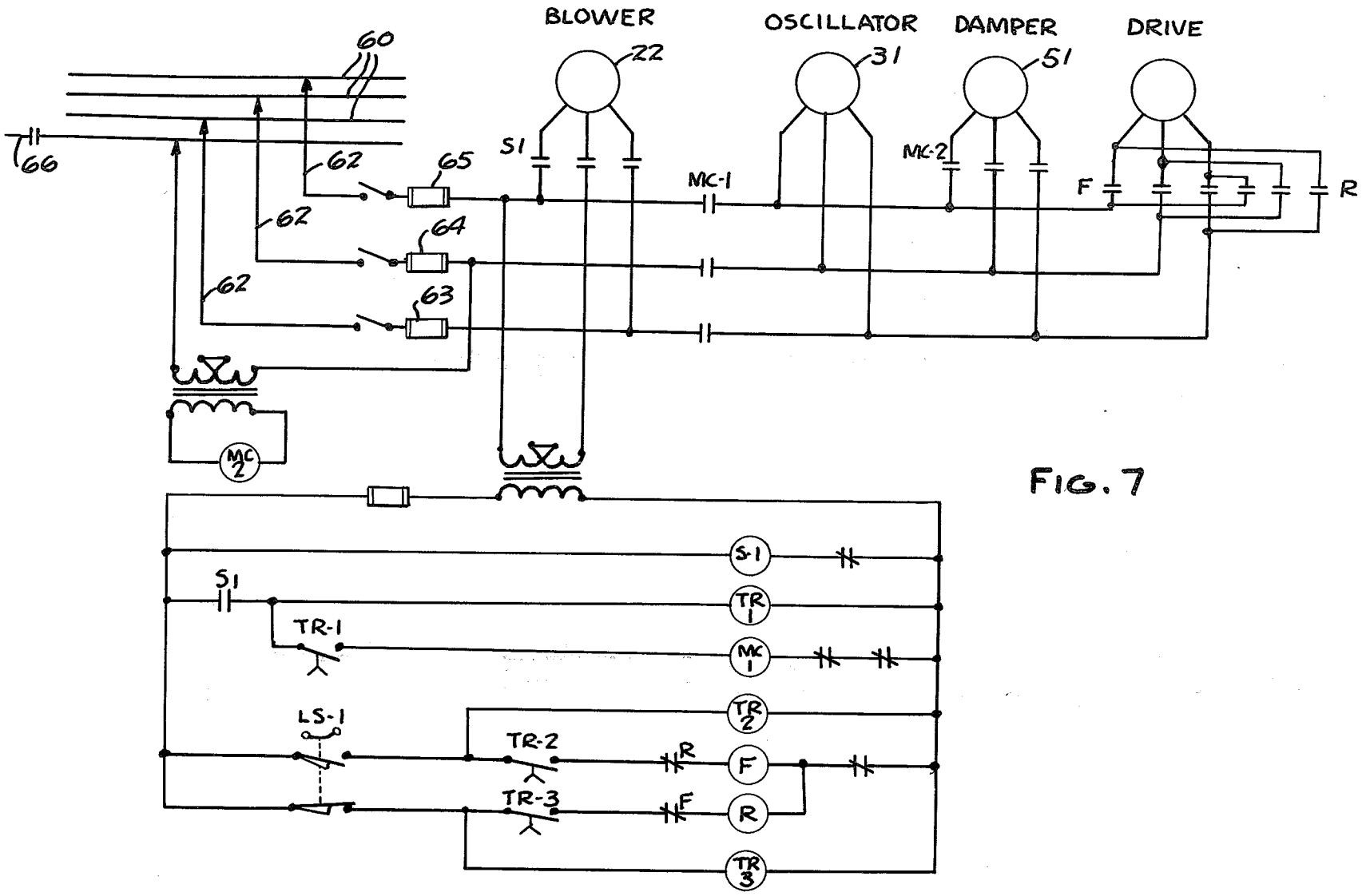
FIG. 7 is a circuit diagram of the loom cleaner.

A typical circuit is shown in FIG. 7 wherein the conductors 60 supply power to the blower motor 22, drive motor M, oscillating motor 31 and motor 51 when switches 63, 64, 65 are closed. At appropriate places along the track corresponding to the areas between filling supply areas of the looms, the conductor 66 for supplying the motor 51 is interrupted so that the motor is not energized. Time delay switch (TR1) delays starting of oscillator motor 31, damper motor 51 and drive motor M, until blower motor 22 is up to speed. Reversing switch LS-1 is actuated at appropriate stations along the track causing delay switches TR-2 and TR-3 to stop drive motor M and reverse direction after it coasts to a stop.

We claim:

1. In a loom cleaner for cleaning a plurality of looms in a row, each said loom having a filling area, the combination comprising a track along a row of looms, a carriage adapted to be moved along said track above the row of looms, a motor on said carriage, a pair of spaced blowers on said carriage, each said blower including a scroll and a fan, each said blower scroll having a tubular outlet with a generally horizontal longitudincal axes extending generally parallel to the direction of movement of said carriage, said motor connected to said fans of said blowers for driving said fans, a plenum associated with the outlet of each blower and mounted for swinging movement about said horizontal axis of said outlet, means for oscillating said plenums about their respective axes, and a plurality of blower tubes extending downwardly from each said plenum.

2. The combination set forth in claim 1 including damper means associated with each said outlet of each said plenum and means for moving said damper means as said carriage is moved along said track to bring said blower tubes over the filling area of said looms, to restrict the flow of air out of said tubes as said tubes are moved over said filling area of each said loom.

3. The combination set forth in claim 2 wherein said damper means each comprise a conical damper.

4. The combination set forth in claim 2 wherein said means for oscillating said plenums comprises means extending between said plenums.

5. The combination set forth in claim 2 including a pair of shafts, each of said damper means being mounted on one of said shafts, means on said carriage supporting said shaft for horizontal movement toward and away from the outlets of said scrolls.

6. In a loom cleaner for cleaning a plurality of looms in a row, the combination comprising a frame adapted to be mounted for movement on a track above the row of looms, a motor on said frame, a pair of spaced blowers on said frame, each said blower including a scroll and a fan, each said blower scroll having a tubular outlet with a generally horizontal longitudinal axis extending generally parallel to the direction of movement of said frame, a horizontal shaft journalled on said frame and driven by said motor and connected to said fans of said blowers, a plenum associated with the outlet of each blower, a plurality of blower tubes extending downwardly from each said plenum, each said plenum being mounted for swinging movement about said horizontal axis of said associated outlet, and means for oscillating said plenums about their respective axes.

7. In a loom cleaner for cleaning a plurality of looms in a row, the combination comprising a carriage adapted to be moved along a track above the row of looms, a motor on said carriage, a pair of spaced blowers on said carriage, each said blower including a scroll and a fan, said motor connected to said fans of said blowers for driving said fans, a plenum associated with the outlet of each blower and mounted for swinging movement about a horizontal axis intersecting said outlet, means for oscillating one of said plenums about its respective axis, and a plurality of blower tubes extending downwardly from each said plenum, damper means associated with each said plenum, each of said damper means being mounted on a shaft, means on said carriage supporting said shafts for horizontal movement toward and away from the outlets of said scrolls, means rotatably mounted on said last-mentioned means connecting said plenums for simultaneously oscillating said plenums.

8. The combination set forth in claim 7 wherein said means for simultaneously oscillating said plenums include a rod interconnecting said means rotatably mounted on said last-mentioned means, a second motor, and means extending from said second motor to one of said plenums.

9. The combination set forth in claim 8 including linkage means interconnecting said shafts.

10. The combination set forth in claim 9 including a motor actuating said linkage means for simultaneously moving said dampers toward and away from said outlets of said scrolls.

11. An apparatus for cleaning a row of shuttleless looms having filling areas individual thereto which comprises a track positioned above said row of looms, a carrier movable along said track, blower means on said carrier having at least one scroll outlet, means connected to said outlet to define a plenum, a plurality of tubes extending downwardly from said plenum for directing streams of air against portions of the looms as the carrier is moved along the track, damper means for modulating the pressure of the airstream through said tubes, and means positioned along said track in relation to each said loom for actuating said last-mentioned means to modulate the air flow being provided by said tubes to the filling area such that air is supplied at a high pressure in advance of and beyond the filling area and at a lower pressure at the filling area.

12. The combination set forth in claim 11 wherein said blower means includes a second scroll outlet and means forming a second plenum associated with said second scroll outlet.

13. The combination set forth in claim 11 wherein said damper means is positioned at the juncture of said scroll outlet and said plenum.

14. The combination set forth in claim 13 wherein said damper means comprises a conical damper and means for mounting said conical damper for movement toward and away from said scroll outlet.

* * * * *